US011248362B2

(12) United States Patent
Zell et al.

(10) Patent No.: US 11,248,362 B2
(45) Date of Patent: Feb. 15, 2022

(54) CLOSED LOOP FEEDBACK CIRCLE DRIVE SYSTEMS FOR MOTOR GRADERS

(71) Applicant: Deere & Company, Moline, IL (US)

(72) Inventors: Adam B. Zell, Dubuque, IA (US); Katherine S. Rogers, Asbury, IA (US)

(73) Assignee: DEERE & COMPANY, Moline, IL (US)

( * ) Notice: Subject to any disclaimer, the term of this patent is extended or adjusted under 35 U.S.C. 154(b) by 239 days.

(21) Appl. No.: 16/669,903

(22) Filed: Oct. 31, 2019

(65) Prior Publication Data

US 2021/0131060 A1 May 6, 2021

(51) Int. Cl.
*E02F 3/84* (2006.01)
*E02F 3/76* (2006.01)

(52) U.S. Cl.
CPC ..... *E02F 3/844* (2013.01); *E02F 3/7668* (2013.01); *F15B 2211/205* (2013.01); *F15B 2211/31* (2013.01); *F15B 2211/6336* (2013.01); *F15B 2211/6346* (2013.01); *F15B 2211/6656* (2013.01)

(58) Field of Classification Search
CPC . E02F 3/845; E02F 3/844; E02F 3/764; E02F 3/847; E02F 3/7668; F15B 2211/6336
See application file for complete search history.

(56) References Cited

U.S. PATENT DOCUMENTS 6,278,955 B1 * 8/2001 Hartman ..... E02F 3/847 172/91
7,729,833 B2 6/2010 Brickner et al.
7,874,377 B1 * 1/2011 Graeve ..... E02F 3/7677 172/796

(Continued)

FOREIGN PATENT DOCUMENTS

DE 19954881 A1 6/2000
DE 102007026527 A1 12/2007

(Continued)

OTHER PUBLICATIONS

German Search Report issued in application No. 102020212111.7 dated Jul. 15, 2021 (08 pages).

*Primary Examiner* — Abiy Teka
(74) *Attorney, Agent, or Firm* — Klintworth & Rozenblat IP LLP

(57) ABSTRACT

A closed loop feedback circle drive system utilized onboard a motor grader includes an operator input device, a blade, and a multi-speed hydraulic motor having a motor output shaft. The motor output shaft is mechanically linked to blade such that motor output shaft rotation drives rotation of the blade about a blade rotation axis. A controller is operably coupled to the operator input device and to the multi-speed hydraulic motor. The controller is configured to: (i) receive blade rotation commands via the operator input device to rotate the blade about the rotation axis in a commanded manner; and (ii) control the multi-speed hydraulic motor to implement the blade rotation commands, while repeatedly adjusting the rotational speed of the motor output shaft to reduce variations in a rotational velocity of the blade due to changes in blade loading conditions occurring during motor grader operation.

20 Claims, 5 Drawing Sheets

(56) References Cited

U.S. PATENT DOCUMENTS

| | | | | |
|---|---|---|---|---|
| 8,746,362 | B2 * | 6/2014 | Bindl | E02F 9/202 172/795 |
| 2008/0000659 | A1 * | 1/2008 | Zachman | E02F 3/845 172/797 |
| 2012/0323451 | A1 | 12/2012 | Shatters et al. | |

FOREIGN PATENT DOCUMENTS

| | | | |
|---|---|---|---|
| DE | 102019132166 | A1 | 6/2020 |
| DE | 102020103789 | A1 | 8/2020 |

* cited by examiner

CLOSED LOOP FEEDBACK CIRCLE DRIVE SYSTEMS FOR MOTOR GRADERS

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to closed loop feedback circle drive systems for controlling a multi-speed circle rotate motor (e.g., a variable displacement or two speed hydraulic motor) utilized to adjust the rotational position of a blade on a motor grader.

BACKGROUND OF THE DISCLOSURE

A motor grader is often equipped with a circle drive system for adjusting the rotational position of a blade-circle assembly; that is, an assembly including a relatively large, generally circular structure or "circle" beneath which a blade is suspended. Conventionally, a circle drive system includes either a hydraulic cylinder arrangement or a fixed displacement hydraulic motor for rotating the blade-circle assembly and, therefore, the blade about a blade rotation axis perpendicular to the motor grader's direction of travel. As a specific example, in one common design, the circle is imparted with a toothed inner periphery, which forms a large annular gear engaged by a smaller gear or pinion. The pinion is mechanically linked to the output shaft of a fixed displacement hydraulic motor, whether directly or indirectly through intervening gearing, such as a gearbox reduction. During motor grader operation, operator commands received via a joystick (or a similar input device) are relayed to a valve actuator, which is mechanically linked to a spool contained in a directional control valve. The valve actuator adjusts the translational position of the spool within the directional control valve in accordance with the operator commands. This regulates the direction and rate of hydraulic fluid flow through the fixed displacement hydraulic motor, which, in turn, drives rotation of the pinon to turn the blade-circle assembly about its rotation axis in the commanded manner.

SUMMARY OF THE DISCLOSURE

Closed loop feedback circle drive systems for usage onboard motor graders are disclosed. In embodiments, the closed loop feedback circle drive system includes an operator input device, a blade rotatable about a blade rotation axis, and a multi-speed hydraulic motor having a motor output shaft. The motor output shaft is mechanically linked to blade such that rotation of the motor output shaft drives rotation of the blade about the blade rotation axis. A controller is operably coupled to the operator input device and to the multi-speed hydraulic motor. The controller is configured to: (i) receive blade rotation commands via the operator input device to rotate the blade about the rotation axis in a commanded manner; and (ii) control the multi-speed hydraulic motor to implement the blade rotation commands, while repeatedly adjusting the rotational speed of the motor output shaft to reduce variations in a rotational velocity of the blade due to changes in blade loading conditions occurring during motor grader operation.

In further embodiments, the closed loop feedback circle drive system includes an operator input device, a blade rotatable about a rotation axis, a multi-speed hydraulic motor having a motor output shaft mechanically linked to the blade, and a first sensor configured to monitor a parameter indicative of a rotational velocity of the blade. A controller is operably coupled to the operator input device, to the multi-speed hydraulic motor, and to the first sensor. The controller is configured to: (i) establish a target blade rotational velocity ($v_{blade_target}$) as a function of operator command signals received via the operator input device; (ii) determine a discrepancy ($v_{blade_\Delta}$) between the target blade rotational velocity ($v_{blade_target}$) and a current blade rotational velocity ($v_{blade_current}$); and (iii) modify a rotational speed of the motor output shaft to reduce the discrepancy ($v_{blade_\Delta}$) between the target blade rotational velocity ($v_{blade_target}$) and the current blade rotational velocity ($v_{blade_current}$) if the discrepancy ($v_{blade_\Delta}$) exceeds a predetermined threshold value.

In yet further embodiments, the closed loop feedback circle drive system includes a two speed hydraulic motor having a motor output shaft. The two speed hydraulic motor is operable in a low torque, high speed (LT/HS) mode and a high torque, low speed (HT/LS) mode. The two speed hydraulic motor is mechanically linked to a blade of the motor grader and is configured to selectively rotate the blade about a rotation axis. The closed loop feedback circle drive system further includes a controller operably coupled to the two speed hydraulic motor. The controller is configured to: (i) selectively shift the two speed hydraulic motor between the LT/HS mode and the HT/LS mode during operation of the motor grader; and (ii) further control a rotational speed of the motor output shaft to minimize variances in a rotational speed of the blade when shifting the two speed hydraulic motor between the LT/HS mode and the HT/LS mode.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
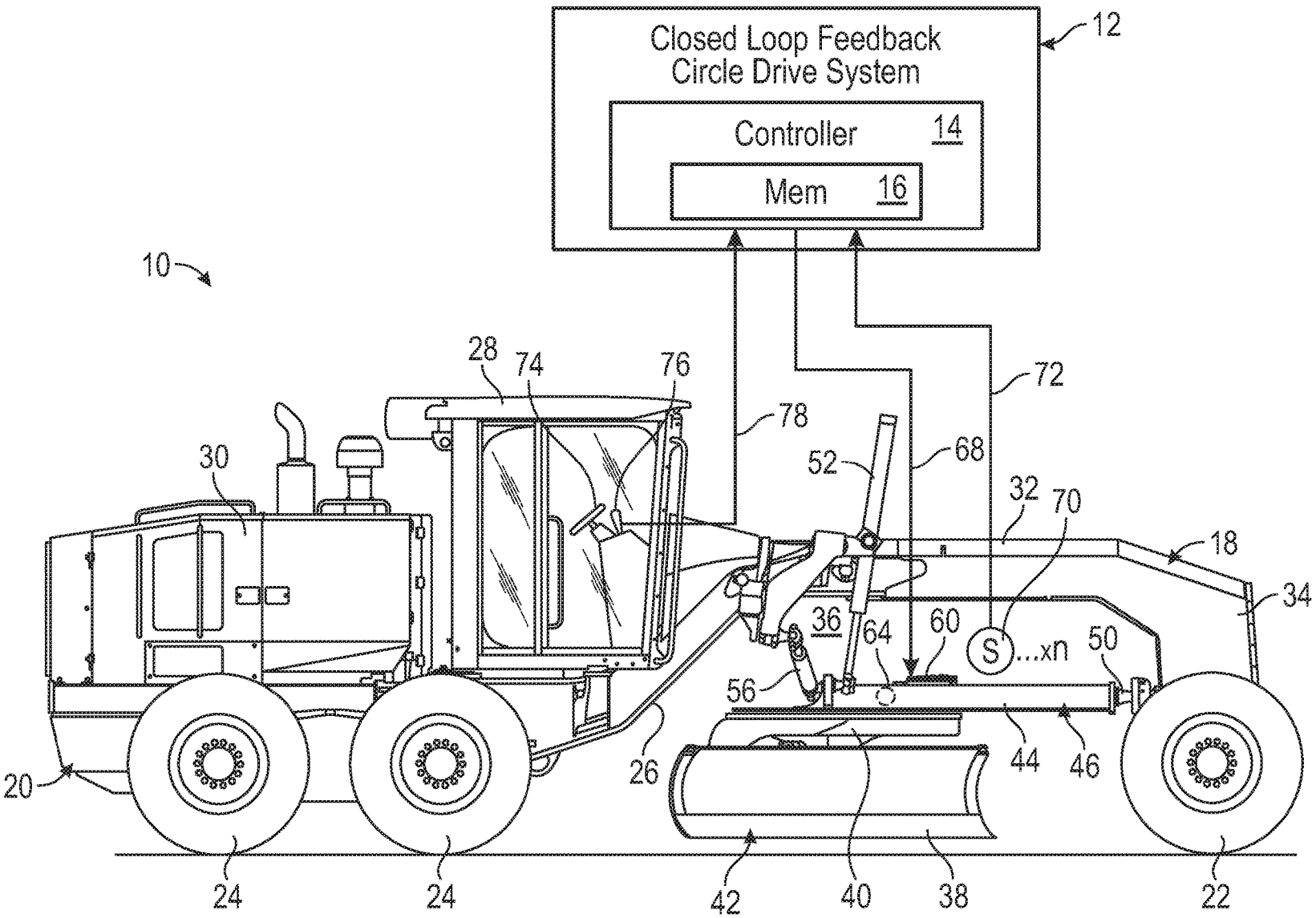
FIG. 1 is a side view of a motor grader equipped with an embodiment of the closed loop feedback circle drive system (partially shown as a schematic), as illustrated in accordance with an example embodiment of the present disclosure.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth the appended claims.

OVERVIEW

As discussed briefly above, legacy circle drive systems commonly rely upon fixed displacement hydraulic motors to drive the rotation of blade-circle assemblies and, therefore, motor grader blades about a blade rotation axis in accordance with operator commands. While reliable, such legacy circle drive systems are associated with various shortcomings. One such shortcoming is encountered during motor grader turnaround; that is, when a motor grader is piloted to reverse its direction of travel, while the blade position is reset to ready the blade for a new earth-moving pass. During turnaround, multiple blade position adjustments are typically performed in rapid sequence. Such blade position adjustments include initially raising the motor grader blade to an above-ground position, rotating the blade to a new angular position (typically the mirror opposite of the previous blade position), and then again lowering the blade into a ground-penetrating position (referred to herein as an "in-ground position"). These and other hydraulically-driven functions of the motor grader can be slowed due to the considerable hydraulic demands of the fixed displacement motor, which is traditionally oversized by design to satisfy peak torque requirements occurring during in-ground blade rotation. Motor grader performance and operator experience may be degraded as a result.

In view of these and other limitations, enhanced circle drive systems incorporating multi-speed hydraulic motors have been developed and implemented. The term "multi-speed hydraulic motor," as appearing throughout this document, is defined to encompass all hydraulic motor types excluding fixed displacement hydraulic motors. The term "multi-speed hydraulic motor" thus includes, but is not limited to, two speed hydraulic motors and variable displacement hydraulic motors as described in detail below. Examples of motor grader circle drive systems incorporating multi-speed hydraulic motors are set-forth in the following document, the contents of which are incorporated by reference: U.S. Pat. No. 7,874,377 B1 entitled "CIRCLE DRIVE ARRANGEMENT FOR MOTOR GRADER," issued by the United States Patent and Trademark Office (USPTO) on Jan. 25, 2011, and assigned to the assignee of the present document (Deere & Company). Through the usage of multi-speed hydraulic motors and other associated components, such enhanced circle drive systems are capable of better accommodating both high speed, low torque rotation of the blade when in an above-ground position (or otherwise lightly loaded) and low speed, high torque rotation of the blade when in an in-ground position (or otherwise heavily loaded). The incorporation of multi-speed hydraulic motors into circle drive systems can consequently satisfy both operational extremes, while avoiding motor oversizing and minimizing the hydraulic demands of the motor. This, in turn, allows the rapid operation of the various hydraulic-driven functions of the motor grader to be maintained during turnaround.

For the reasons above, the development and implementation of circle drive systems incorporating multi-speed hydraulic motors represents a significant advancement in motor grader design. This notwithstanding, current circle drive systems incorporating multi-speed hydraulic motors remain limited in certain respects. As a primary limitation of such circle drive systems, the usage of a multi-speed hydraulic motor to drive blade rotation can result in undesired fluctuations in blade rotational speed in conjunction with variations in blade loading. Such fluctuations in blade rotational speed can be significant and may be perceptible to motor grader operators. This may detract from operator satisfaction and efficiency, particularly when non-trivial disparities develop between control input (e.g., joystick) displacements and the blade rotational speed across different iterations of motor grader operation. An ongoing industry demand consequently exists for circle drive systems increasing the consistency in which operator blade rotation commands result in an expected blade rotation speed output, while the correlation between blade rotation speed and blade loading is largely, if not wholly severed. Concurrently, it is desirable for such a circle drive system to retain the above-described benefits associated with the usage of a multi-speed hydraulic motor to drive blade rotation and preserve the rapid execution of hydraulic-driven functions during motor grader turnaround.

In satisfaction of this ongoing industrial demand, the following sets-forth circle drive systems utilized onboard motor graders and incorporating multi-speed hydraulic motors, which are operated in accordance with unique, closed loop feedback control schemes. The closed loop feedback control schemes are implemented by a controller, which is operably coupled to the multi-speed hydraulic motor and to at least one operator input device (e.g., a joystick) utilized to control the angular position of motor grader blade. As appearing throughout this document, the term "controller" is utilized in a non-limiting sense to refer generally to the processing architecture of a closed loop feedback circle drive system. The controller can encompass or may be associated with any number of processors, control computers, computer-readable memories, power supplies, storage devices, interface cards, and other standardized components. The controller may also include or cooperate with any number of firmware and software programs or computer-readable instructions designed to carry-out the various process tasks, calculations, and control functions described herein. Such computer-readable instructions may be stored in a non-volatile sector of the memory accessible to the controller, as further described below.

The controller may implement various different control schemes to regulate the rotational speed and direction of the multi-speed hydraulic motor's output shaft during operation of the closed loop feedback circle drive system. In embodiments, the controller may initially establish a commanded or "target" blade rotational velocity ($v_{blade_target}$) as a function of blade rotation commands received via the operator input device. The controller may then control the multi-speed hydraulic motor to implement the blade rotation commands, while selectively adjusting the rotational speed of the motor output shaft to reduce discrepancies between the target blade rotational velocity ($v_{blade_target}$) and a current blade rotational velocity ($v_{blade_current}$) due to variations in load forces resisting blade rotation. For example, in certain embodiments, the controller may initially calculate any discrepancy ($v_{blade_\Delta}$) between the target blade rotational velocity ($v_{blade_target}$) and the current blade rotational velocity ($v_{blade_current}$). The controller may then modify the rotational speed of the motor output shaft to reduce any such discrepancy ($v_{blade_\Delta}$) if exceeding a predetermined threshold value. The predetermined threshold may have a zero value in certain embodiments; but, more usefully, has a non-zero (fixed or variable) value to avoid small, redundant blade angle adjustments or "flutter" of the motor grader blade. The controller repeats this process, preferably on a relatively rapid (e.g., real-time) iterative basis, to provide closed loop feedback control scheme maintaining the rotational speed of the motor grader blade at target levels independently of (or with a reduced dependence on) variations in blade loading conditions.

The controller may monitor the current blade rotational velocity ($v_{blade_current}$) utilizing data received from one or more sensors further included in the closed loop feedback circle drive system. For example, in certain embodiments, the controller may receive data from a sensor (e.g., a rotary variable differential transformer) monitoring the angular position of the motor grader blade or, perhaps, another component that co-rotates with the blade in a fixed relationship. The controller may then utilize this sensor input to track changes in blade angle over time and, therefore, the current blade rotational velocity ($v_{blade_current}$). In other implementations, the controller may receive data input from a rotational speed sensor, such as a Microelectromechanical Systems (MEMS) accelerometer and/or gyroscope, which is configured to monitor the rotational speed of an output shaft of the multi-speed hydraulic motor, the rotational speed of the motor grader blade or blade-circle assembly itself, or the rotational speed of another component in the rotation transmission path extending from the hydraulic motor to the blade-circle assembly. The controller then utilizes this sensor input to determine the current blade rotational velocity ($v_{blade_current}$) for comparison to the target blade rotational velocity ($v_{blade_target}$), as previously described.

The particular manner in which the controller controls (that is, influences the operation of) the multi-speed hydraulic motor will vary between embodiments. When the multi-speed hydraulic motor assumes the form of a variable displacement hydraulic motor having a variable displacement control mechanism, the controller may utilize the variable displacement control mechanism to repeatedly alter a displacement setting of the hydraulic motor in adjusting the rotational speed of the motor output shaft. Further, in addition to selectively modifying displacement setting of the hydraulic motor, the controller may also repeatedly adjust the position of a value element (e.g., a spool) contained in a directional control valve to vary the rate and direction of hydraulic fluid flow through the variable displacement hydraulic motor, thereby further controlling the rotational speed and direction of the motor output shaft. In still other instances, the controller may modify the speed and/or rotational direction of the motor output shaft in another manner, such as by controlling the flow output of a pump upstream of the multi-speed hydraulic motor. Comparatively, in embodiments in which the multi-speed hydraulic motor assumes the form of a two speed hydraulic motor, the controller may likewise control motor output speed (and rotational direction) by adjusting the rate and direction of hydraulic fluid flow through the hydraulic motor; e.g., by adjusting the translational position of a spool within a directional control valve upstream of the two speed hydraulic motor. However, in this latter case, an additional layer of control complexity is introduced by the ability of the two speed hydraulic motor to operator in at least two modes, which are referred to herein in a relative sense as "a low torque, high speed (LT/HS) mode" and "a high torque, low speed (HT/LS) mode." Accordingly, in such instances, the controller may determine when to shift the two speed hydraulic motor between these operational modes, while further controlling the hydraulic motor to minimize the variation in motor speed when shifting between the operation modes. This may render shifting of the two speed hydraulic motor less perceptible to a motor grader operator to improve operator experience.

In implementations in which the circle drive system incorporates a two speed hydraulic motor having first and second power elements, the controller may transition or shift between motor operational modes by varying whether the power elements are fluidly coupled in parallel or in series. For example, in one possible implementation, the controller may be coupled to a selector valve containing a bi-stable valve element, such as a spool. The spool may be movable between two stable positions to determine whether the power elements are fluidly coupled in parallel (placing the two speed hydraulic motor in the HT/LS mode) or in series (placing the hydraulic motor in the LT/HS mode). During operation of the closed loop feedback circle drive system, the controller may determine when to transition the two speed hydraulic motor between its operational modes based, at least in part, on receipt of at least one sensor input indicative of a blade load. Such a sensor input may be received from a sensor configured to measure blade load in a direct manner; e.g., as in the case of a force sensor mechanically coupled between the motor output and the blade. In other instances, the sensor input may be provided by a sensor configured to monitor a parameter indirectly indicative of blade load; e.g., by monitoring hydraulic pressures within the flow circuit of the circle drive system utilizing one or more pressure sensors, as further described below. Additionally or alternatively, in such embodiments, the controller of the circle drive system may also be configured to selectively shift the two speed hydraulic motor between operational modes in response to a predicted or anticipated change in blade loading conditions. For example, in certain implementations, the controller may shift the two speed hydraulic motor to the HT/LS mode when determining that the motor grader blade has been lowered from an above-ground into an in-ground position (or has been lowered to a certain penetration depth); and then return the hydraulic motor to the LT/HS mode when the blade is again raised to the above-ground position.

Progressing now to the accompanying drawing figures, an example embodiment of a closed loop feedback circle drive system including a two speed hydraulic motor is discussed below in connection with FIGS. 3 and 4, while an example embodiment of a closed loop feedback circle drive system containing a variable speed hydraulic motor is further discussed below in connection with FIG. 5. First, however, an example motor grader usefully equipped with an embodiment of the closed loop feedback circle drive system is described below in connection with FIGS. 1 and 2. While discussed below in the context of a particular type of motor grader having certain features, embodiments of the closed loop feedback circle drive system can be utilized onboard various different types of motor graders without limitation.

EXAMPLE MOTOR GRADER EQUIPPED WITH A GENERALIZED CLOSED LOOP FEEDBACK CIRCLE DRIVE SYSTEM

Figure 2:
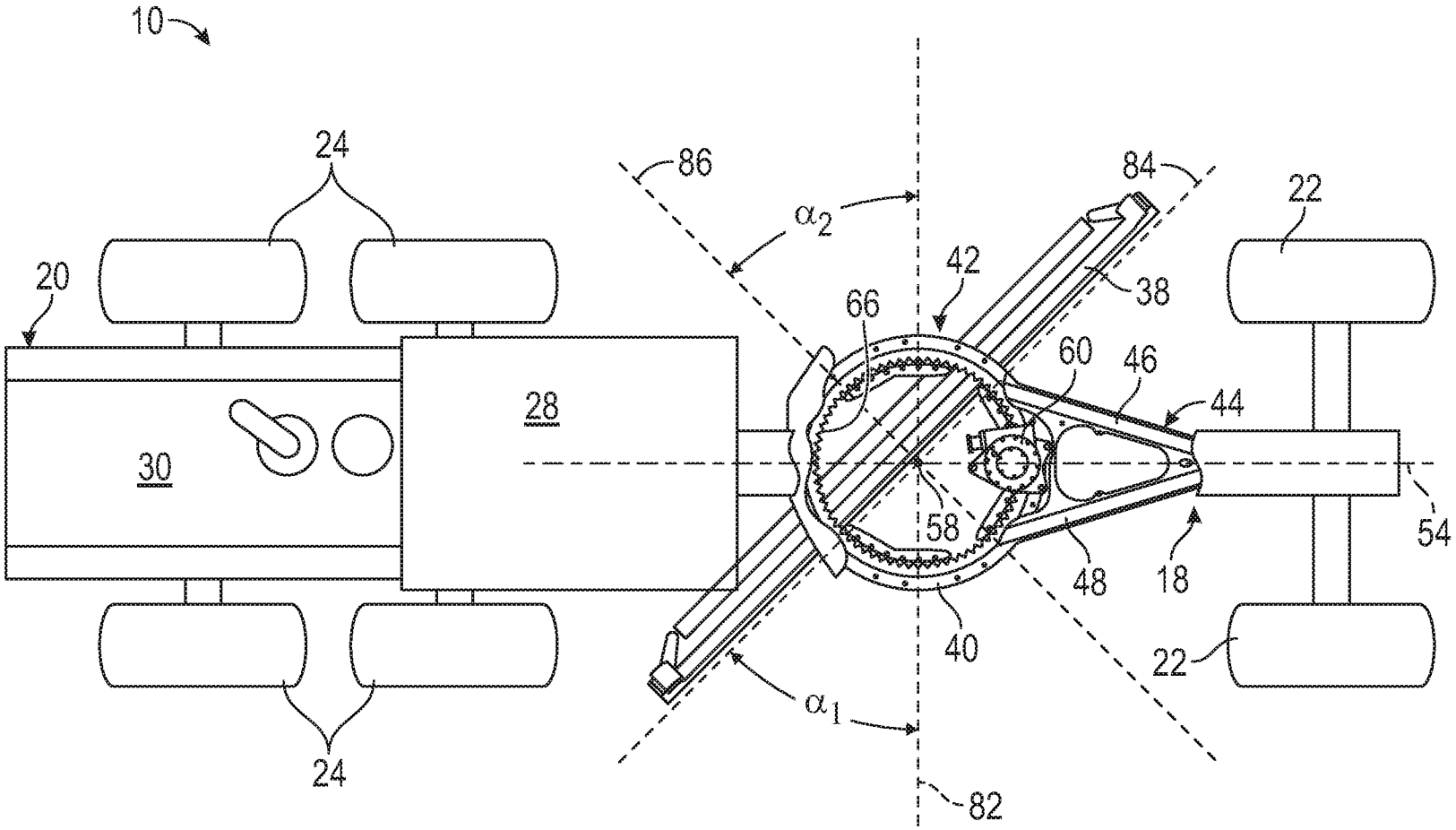
FIG. 2 is a top-down or planform view of the motor grader shown in FIG. 1 illustrating example displacements of the blade-circle assembly and, therefore, the motor grader blade about a blade rotation axis.

Referring now to FIGS. 1 and 2, an example motor grader 10 equipped with a closed loop feedback circle drive system 12 is presented. For illustrative clarity, only selected components of the closed loop feedback circle drive system 12 are schematically depicted in FIG. 1 including, for example a controller 14 and a computer-readable memory 16. As noted above, the term "controller" is defined herein to broadly encompass the processing architecture of the circle drive system 12, which executes certain control schemes (examples of which are described below) in accordance with computer-readable instructions or code stored in the memory 16. Moreover, while generically illustrated as a single block, the memory 16 can encompass any number and type of storage media suitable for storing computer-readable code or instructions, as well as other data utilized to support the operation of the closed loop feedback circle drive system 12. Additional components that may be contained in specific implementations of the example closed loop feedback circle drive system 12 are further discussed below in connection with FIGS. 3-5; first, however, the construction and operation of the motor grader 10 is discussed to provide a non-limiting context in which the closed loop feedback circle drive system 12 may be better understood.

In the example embodiment of FIGS. 1 and 2, the motor grader 10 includes a front frame 18 and a rear frame 20, which is hingedly joined to a trailing section of the front frame 18. The front frame 18 is supported by a pair of front ground-engaging wheels 22, while the rear frame 20 is likewise supported by left and right tandem rear wheel sets 24. An operator cabin 28 is located immediately aft of an inclined forward section 26 of the rear frame 20. An engine (hidden from view) is contained within an engine bay housing 30, which is further mounted to the rear frame 20 at a location immediately aft of the operator cabin 28. During operation of the motor grader 10, the engine (e.g., an internal combustion engine) within the engine bay housing 30 supplies motive power to the rear wheels 24 through a non-illustrated transmission. The front wheels 22 of the motor grader 10 may also be driven through a non-illustrated a hydrostatic assist transmission.

Referring specifically to the front frame 18 of the motor grader 10, the front frame 18 includes an upper, longitudinally-elongated section 32 (hereafter, the "elevated section 32") and a leading, vertically-elongated nose section 34 (hereafter the "leading end section 34"). Jointly, the sections 32, 34 impart the front frame 18 with a generally L-shaped geometry, as viewed from a side of the motor grader 10. Due to the L-shaped geometry of the front frame 18, a spatial volume or envelope 36 is created beneath the front frame 18 for accommodating a motor grader implement 38. As depicted in FIGS. 1 and 2, the motor grader implement 38 will often assume the form of an earth-moving (or other material-moving) blade and is consequently referred to hereafter as a "blade 38." This example notwithstanding, the blade 38 may be interchanged with other motor grader implements, such as a snowplow implement, in other instances. The blade 38 is suspended beneath a relatively large structure or "circle" 40 having a generally circular formfactor, as seen from the top-down or planform viewpoint (FIG. 2). Collectively, the blade 38 and the circle 40 form a rotatable blade-circle assembly 42, as further discussed below. While is fully shown in FIG. 1, portions of the front frame 18 are visually cutaway or hidden from view in FIG. 2 to better the blade-circle assembly 42.

A drawbar 44 having angled legs 46, 48 extends from the leading end section 34 of the front frame 18 to the circle 40 of the blade-circle assembly 42. Due to the angled orientation of the legs 46, 48, the drawbar 42 has a substantially V-shaped formfactor when viewed from a top-down perspective (FIG. 2). At its forward (narrow) end, the drawbar 44 is joined to the leading end section 34 by a multi-degree of freedom joint 50, such as a ball-and-socket joint. Two linear actuators (here, hydraulic cylinders 52) are further pivotally mounted between the front frame 18 and the legs 46, 48 of the drawbar 44. The cylinders 52 (only one of which can be seen) permit angular adjustments of the blade-circle assembly 42 about a longitudinal or yaw axis of the front frame 18, as represented by a dashed line 54 in FIG. 2. Similarly, a hydraulic cylinder 56 is mounted between the front frame 18 and the blade-circle assembly 42 for further adjusting the angular orientation of the motor grader blade 38 (specifically, the side shift angle fo the blade 38) in accordance with operator commands received via input control devices located within the cabin 28, as further described below.

With continued reference to FIGS. 1 and 2, the example motor grader 10 is further equipped with a hydraulic circle rotate motor 60 included in the closed loop feedback circle drive system 12. The hydraulic circle rotate motor 60 is configured to adjust the angular orientation of the blade-circle assembly 42 and, therefore, the blade 38 about a blade rotation axis 58 (identified in FIG. 2). The hydraulic circle rotate motor 60 includes a motor output shaft (examples of which are shown in FIGS. 3-5), which is mechanically linked to a gear or pinion 64. The output shaft of the hydraulic circle rotate motor 60 may be directly joined to the pinion 64 (e.g., via a splined coupling); or, instead, the motor shaft may be mechanically linked to the pinion 64 through any number of intervening components, such as a gearbox reduction. In either instance, the pinion 64 has a toothed outer periphery positioned in mesh engagement with a toothed inner periphery 66 of the circle 40 of the blade-circle assembly 42. The circle 40 thus serves as a relatively large annular gear, the rotation fo which is driven by the rotation of the pinion 64.

The controller 14 of the closed loop feedback circle drive system 12 is coupled to the hydraulic circle rotate motor 60 in a manner enabling the controller 14 to modify certain operational aspects of the motor 60, including the rotational speed and direction of the motor output shaft. The operational relationship between the controller 14 and the hydraulic circle rotate motor 60 is generically indicated in FIG. 1 by a control line 68. In various embodiments, the controller 14 may modify the output speed and direction of the output shaft of the hydraulic circle rotate motor 60 based, at least in part, on data received from one or more sensors 70 included in the closed loop feedback circle drive system 12. The data connection 72 between the sensor(s) 70 and the controller 14 can be a wired connection, a wireless connection, or a combination thereof. The sensor or sensors 70 can monitor various different operational parameters utilized in implementing the below-described blade rotation control schemes. Such parameters may include, but are not limited to, data indicative of the rotational velocity (speed and rotational direction) of the motor grader blade 38; data indicative of the rotational speed of the motor output shaft; data indicative of the angular position of the blade 38 about the blade rotation axis 58; and/or data indicative of load forces resisting blade rotation about the axis 58. In certain embodiments, the sensor(s) 70 may also supply the controller 14 with data indicative of an excepted or anticipated load applied to the motor grader blade 38; e.g., as may be inferred from data indicating whether the blade 38 currently resides in an above-ground or in-ground position. Further description of potential implementations of the sensor(s) 70 and the hydraulic circle rotate motor 60, and examples control schemes suitably executed by the controller 14 during operation of the motor grader 10, are discussed more fully below in connection with FIGS. 3-5.

A steering wheel 74 and other operator input devices 76 are located within the cabin 28 of the example motor grader 10. While seated or standing within the cabin 28, an operator manipulates the steering wheel 74 and the other operator input devices 76 to control various operational aspects of the motor grader 10, including rotation of the blade-circle assembly 42 about the blade rotation axis 58. The operator input devices 76 will often include at least one joystick or lever, which is manipulated by an operator to control the rotation of the blade-circle assembly 42 and, therefore, the motor grader blade 38. This notwithstanding, the operator input devices 76 can assume any form suitable for receiving operator input commands (including blade rotation commands) specifying operator-desired adjustments to the positioning of the blade-circle assembly 42. Accordingly, the operator input devices 76 can include or may assume the form of various other physical input devices (e.g., buttons, dials, switches, and the like) and devices (e.g., a trackball or touchscreen interface) for interacting with Graphical User Interface (GUI) elements generated on a display screen located within the operator cabin 28. The controller 14 receives such operator input command from the operator input devices 76 over a wired or wireless data connection 78, and then converts such operator input commands to positional adjustments or movement of the blade-circle assembly 42 accordingly.

The angle of the motor grader blade 38, as taken about the blade rotational axis 58, may be described in terms of the rotational displacement of the blade 38 relative to a virtual reference plane 82 (FIG. 2). The reference plane 82 may bisect the circle 40 and is substantially orthogonal to the direction of motor grader travel. In this regard, consider an example scenario in which the motor grader blade 38 is rotated from a neutral position (that is, a position aligned with the reference plane 82) to the position corresponding to the dashed line 84, with the line 84 indicating the angular orientation of the front face of the blade 38. To arrive at this position, the blade 38 is rotated by a first angular displacement ($\alpha_1$) in a first rotational direction (clockwise in the illustrated example) due to the action of the multi-speed hydraulic motor 60 under the command of the controller 14. This brings the blade 38 into an operator-commanded position to, for example, prepare the motor grader 10 for performance of a first earth-moving pass across a given work area. After the motor grader 10 performs this pass, the operator may then command the motor grader 10 to turnaround for a subsequent pass over the work area. During turnaround, the operator further controls the motor grader blade 38 to reset the blade angle (that is, return the blade 38 to the neutral position aligned with the reference plane 82) and then rotates the blade 38 by an equivalent angular displacement ($\alpha_2$) in a second, opposing rotational direction (clockwise in the illustrated orientation of FIG. 2). This brings the blade 38 into an angular position corresponding to a dashed line 86, which is the mirror opposite of the blade position corresponding to the line 84 relative to the reference plane 82. So positioned, the blade 38 continues to move earth (or another material) to the same side of the motor grader 10 as the motor grader 10 reverse its direction of travel and performs a subsequent earth-moving pass across the work area.

As previously stated, the hydraulically-driven functions of the motor grader 10 can be greatly slowed during turnaround when relying upon a circle drive system containing a fixed displacement hydraulic motor to rotate the blade-circle assembly 42 and the blade 38. For at least this reason, the hydraulic circle rotate motor 60 assumes the form of a multi-speed hydraulic motor in the illustrated example and is consequently referred to hereafter as the "multi-speed hydraulic motor 60." Due to its ability to vary the relationship between the volume of hydraulic fluid passed through the hydraulic motor 60 per turn of the motor output shaft, the multi-speed hydraulic motor 60 can be controlled by the controller 14 (FIG. 1) to better accommodate both high speed, low torque rotation of the motor grader blade 38 and low speed, high torque rotation of the blade 38. Additionally, as the hydraulic demands of the multi-speed hydraulic motor 60 are reduced relative to a fixed displacement motor employed for the same usage, rapid operation of the various hydraulic-driven functions of the motor grader 10 (including raising, turning, and lowering the motor grader blade 38) can be preserved during motor grader turnaround.

While providing the above-noted advantages, the usage of a multi-speed hydraulic motor for blade rotation purposes can result in undesired fluctuations in blade rotational speed in conjunction with variations in blade loading conditions, absent the provision of adequate countermeasures. Therefore, the motor grader 10 is further equipped with the closed loop feedback circle drive system 12, which functions to minimize or eliminate variations in blade rotational speed in response to variations in blade loading occurring during motor grader operation. The particular manner in which the closed loop feedback circle drive system 12 is implemented will inevitably vary among embodiments based, at least in part, on the form assumed by the multi-speed hydraulic motor 60; e.g., whether the multi-speed hydraulic motor 60 assumes the form of, for example, a two speed hydraulic motor or instead a variable displacement hydraulic motor. To further emphasize point, a first example implementation of the closed loop feedback circle drive system 12 incorporating a two speed hydraulic motor will now be described in conjunction with FIGS. 3 and 4. Following this, a second example implementation of the closed loop feedback circle drive system 12 incorporating a variable displacement hydraulic motor is set-forth below in connection with FIG. 5.

EXAMPLE IMPLEMENTATION OF THE CLOSED LOOP FEEDBACK CIRCLE DRIVE SYSTEM INCLUDING A TWO SPEED HYDRAULIC MOTOR

Figure 3:
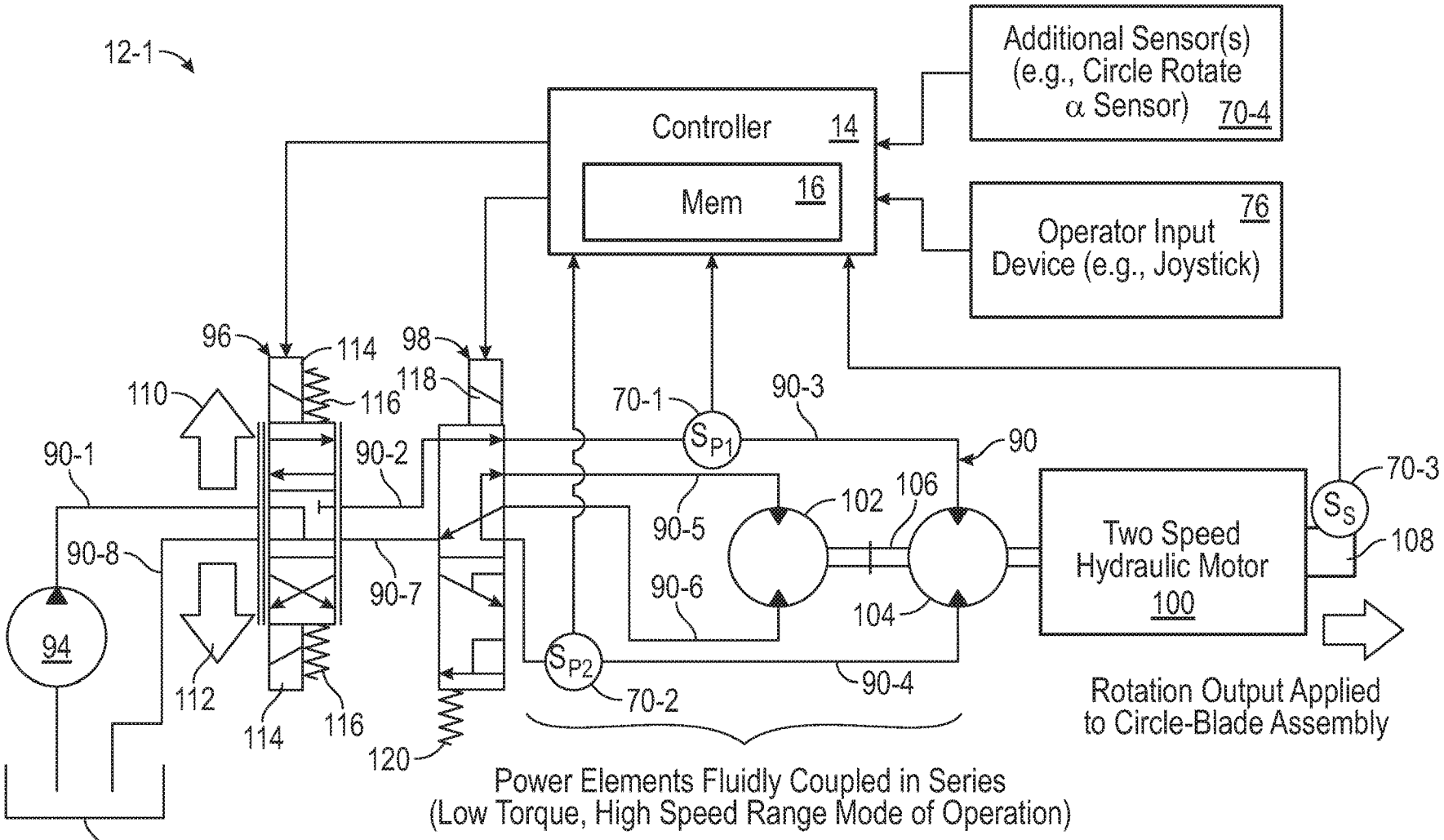
FIGS. 3 and 4 are schematics of a first example implementation of a closed loop feedback circle drive system (suitable for usage as the circle drive system generically shown in FIG. 1) including a two speed hydraulic motor operable in a low torque, high speed mode (FIG. 3) and a high torque, low speed mode (FIG. 4)
Figure 4:
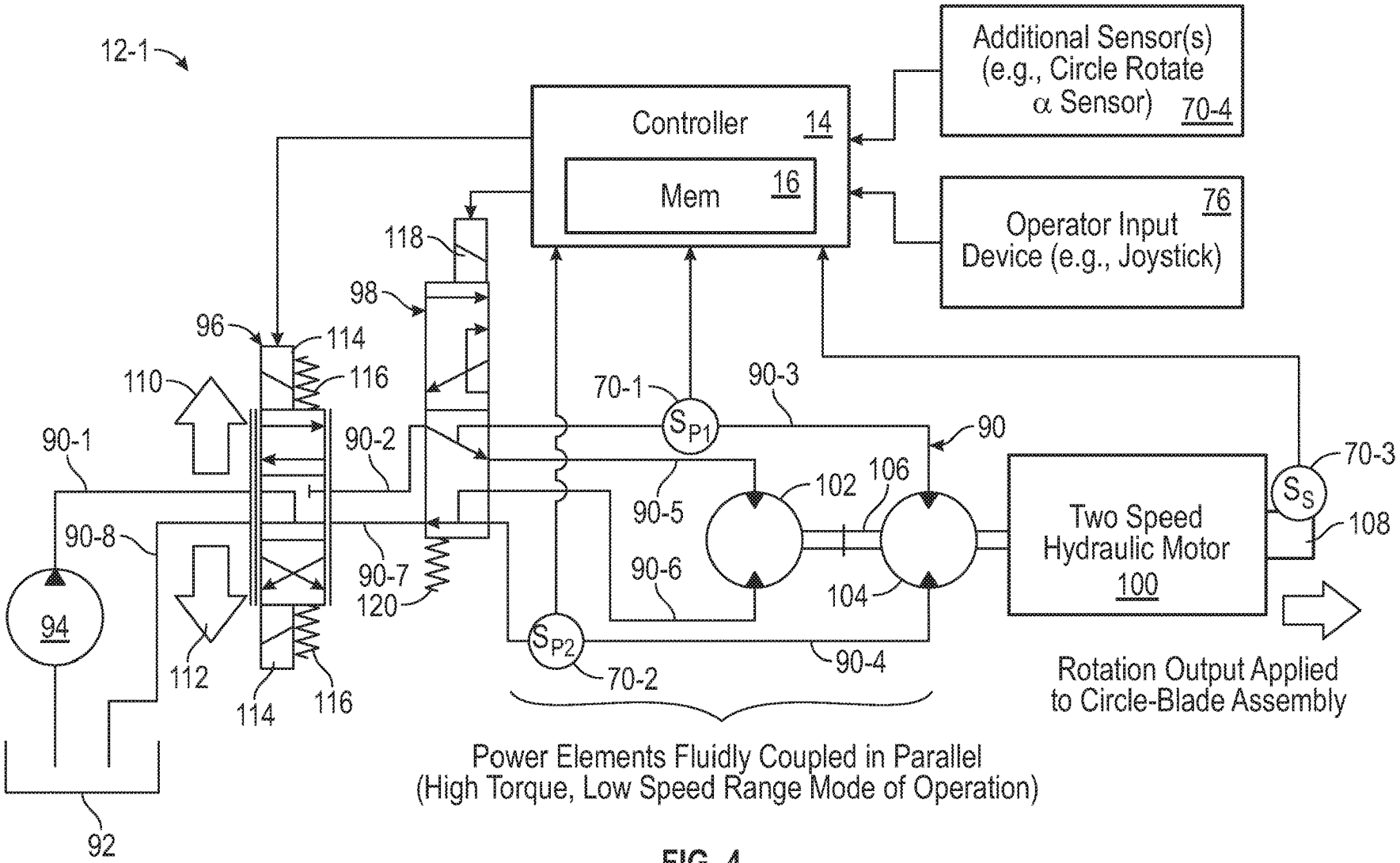

FIGS. 3 and 4 are schematics of a first example implementation of a closed loop feedback circle drive system 12-1; the suffix "-1" denoting that the illustrated circle drive system 12-1 represents but one possible implementation of the generalized circle drive system 12 described above in connection with FIG. 1. Other reference numerals are also carried-over from the previous drawing figures where appropriate; noting, for example, the labeling of the controller 14, the memory 16, and the operator input device 76 in FIGS. 3 and 4. In addition to the foregoing components, the closed loop feedback circle drive system 12-1 further includes a plurality of sensors 70, with correspond to the sensor(s) 70 shown in FIG. 2. The sensors 70 include two pressures sensors 70-1, 70-2, a rotation speed sensor 70-3, and any number of additional sensors 70-4, such as a circle rotate angle sensor. The sensors 70, and manners in which the controller 14 may consider the data input provided by the sensors 70 in controlling the various components of the circle drive system 12-1, are discussed below. First, however, the hydraulic components of the closed loop feedback circle drive system 12-1 will be described.

A flow network 90, which is comprised of a number of flowlines 90-1 through 90-8, interconnects the hydraulic components of the closed loop feedback circle drive system 12-1. These hydraulic components include: (i) a sump 92, (ii) a pump 94, (iii) a directional control valve 96, (iv) a mode selector valve 98, and (v) a two speed hydraulic motor 100 (corresponding to the hydraulic circle rotate motor 60 shown in FIGS. 1 and 2). The two speed hydraulic motor 100 includes, in turn, a first power element 102 and a second power element 104, which are fluidly interconnected via the flow network 90. The power elements 102, 104 are mounted to a common shaft 106 of the two speed hydraulic motor 100, which corotates (and may be integrally formed) with an output shaft 108 further included in the hydraulic motor 100. During operation of the closed loop feedback circle drive system 12-1, hydraulic fluid is directed through the power elements 102, 103 to drive rotation of the motor output shaft 108. The closed loop feedback circle drive system 12-1 can further include various other hydraulic components in actual implementations, such as additional (e.g., booster) pumps, filters, check valves, and the like; however, such components are tangential to the core functions of the circle drive system 12-1 and are thus not shown to avoid obscuring the drawings.

In the example implementation shown in FIGS. 3 and 4, the directional control valve 96 assumes the form of a four-way, three-position spool-type valve. Accordingly, the directional control valve 96 includes a spool (generically, a "valve element"), which is disposed in a valve housing or sleeve for translational movement therein. The spool is shown in an intermediate or neutral position in the illustrated schematic and can move in either direction along its translational axis from this position, as indicated by arrows 110, 112. The positioning of the spool within the directional control valve 96 is set by the controller 14 utilizing one or more valve actuator(s) 114 further included in or associated with the control valve 96. When energized or otherwise actuated, the valve actuator(s) 114 act in concert with or in opposition to bias forces exerted on the spool by one or more spring elements 116, such as coiled compression springs, contained within the sleeve of the directional control valve 96. The valve actuator(s) 114 can be a solenoid or a solenoid pair in embodiments, which is selectively energized by the controller 14 to determine set the translational position of the spool within the directional control valve 96. In other embodiments, the valve actuator 114 can assume various other forms, such as that of hydraulic actuator, another type of electric actuator, or a combination thereof.

During operation of the closed loop feedback circle drive system 12-1, the controller 14 commands the valve actuator(s) 114 to selectively adjust the translation position of the spool within the sleeve of the directional control valve 96. Controlling the spool position in this manner influences the rate and direction of fluid flow through the control valve 96 and, therefore, through the two speed hydraulic motor 100. Consider, for example, a scenario in which the controller 14 commands the valve actuator 114 to move the spool in the direction indicated by the arrow 112 from the neutral position (downwardly in the illustrated schematic). In this case, the directional control valve 96 directs fluid flow through the primary flow circuit (that is, the flow circuit downstream of the directional control valve 96 consisting of the flowlines 90-2 through 90-7) in a first flow direction, as indicated by the upper pair of arrows within the corresponding valve symbol. This generally results in a clockwise flow in illustrated schematic to drive rotation of the motor output shaft 108 in a first rotational direction. As the spool slides further toward the positional extreme corresponding to the arrow 112, the flow rate through the directional control valve 96 increases (providing the other flow conditions remain constant) along with the rotational speed of the motor output shaft 108. Conversely, from the neutral position (FIGS. 3 and 4), movement of the spool in the opposing direction corresponding to the arrow 110 provides the port-to-port connections indicated by the lower pair of arrow symbols in the schematic representation of the directional control valve 96. Accordingly, the direction of hydraulic fluid flow through the primary flow circuit is reversed (providing essentially counterclockwise flow in the illustrated schematic), which drives rotation of the motor output shaft 108 in a second, opposing direction. Once again, the flow rate through the directional control valve 96 increases as the spool moves further toward the positional extreme corresponding arrow 112, which further accelerates rotation of the motor output shaft 108 in the second rotational direction.

By adjusting the translational position of the spool within the directional control valve 96 in the manner just described, the controller 14 can selectively modify the rotational speed and direction of the motor output shaft 108 and, therefore, the rotational speed and direction of the motor grader blade 38 about the blade rotation axis 58 (FIG. 2). In certain implementations, the controller 14 may further control the speed and direction of the motor output shaft 108 in other manners, as well, such as by controlling the pump 94 to regulate pump outflow if the pump 94 is able to be controlled in this manner; although such a control mechanism may not be employed in embodiments, such as when the pump 94 is gear-driven. In other instances, the controller 14 may control the speed and direction of the motor output shaft 108 both by modulating of the directional flow control valve 96 and, also, by selectively transitioning or shifting the two speed hydraulic motor 100 between multiple operational modes. In the illustrated example, specifically, the controller 14 further controls the speed and direction of the motor output shaft 108 by selectively shifting the two speed hydraulic motor 100 between two operational modes utilizing the mode selector valve 98, as will now be described.

As does the directional control valve 96, the mode selector valve 98 assumes the form of a four-way, three-position spool-type valve in the illustrated implementation. Movement of the spool contained within the mode selector valve 98 is controlled utilizing a valve actuator 118, such as a solenoid. As commanded by the controller 14, the valve actuator 118 urges spool movement in a particular translational direction (downward in the illustrated orientation) when the output force of the actuator is sufficient to overcome a bias force further exerted on the spool by at least one spring element 120, such as a coil spring, within the sleeve of the mode selector valve 98. In contrast to the directional control valve 96, the mode selector valve 98 is imparted with a bi-stable design in the illustrated example. Accordingly, the spool of the mode selector valve 98 is movable between a first stable position (shown in FIG. 3) and a second stable position (shown in FIG. 4). Movement of the spool within the mode selector valve 98 into the first stable position (FIG.

3) fluidly places the power elements 102, 104 in flow series, thereby shifting the two speed hydraulic motor 100 into the LT/HS mode of operation. Conversely, movement of the mode selector valve 98 into the second stable position (FIG. 4) places the power elements 102, 104 in a parallel flow arrangement, which shifts the hydraulic motor 100 into the HT/LS mode of operation.

As just stated, movement of the mode selector valve 98 into the first stable position (FIG. 3) fluidly couples the power elements 102, 104 in flow series. To further illustrate this point, assume the spool of the directional control valve 96 is moved into the positional extreme corresponding to the arrow 112 in FIG. 3. In this case, the mode selector valve 98 initially receives hydraulic fluid flow from the directional control valve 96 via the flowline 90-2, with the valve 98 then routing this hydraulic fluid flow into the flowline 90-3. The hydraulic fluid flows through the flowline 90-3, through the power element 104, through the flowline 90-4, and ultimately returns to the mode selector valve 98. Following this, the mode selector valve 98 redirects the hydraulic fluid flow into the flowline 90-5, which conducts the fluid flow through the power element 102. From the power element 102, the hydraulic fluid then flows through the flowline 90-6 back to the mode selector valve 98. The returning hydraulic fluid passes through the mode selector valve 98, enters the flowline 90-7, flows through the directional control valve 96, and is finally returned to the sump 92 via the flowline 90-8. This results rotation of the motor output shaft 108 in a first rotational direction; and, correspondingly, the rotation of the motor grader blade 38 in a first rotational direction about the blade rotation axis 58 (FIG. 2). Generally, then, in the example scenario of FIG. 3, the hydraulic fluid discharged from the pump 94 is directed through the power elements 102, 104 of the two speed hydraulic motor 100 in flow series to provide low torque, high speed operation of the motor 100. This operational mode of the two speed hydraulic motor 100 is optimal for driving blade rotation when the motor grader blade 38 is lightly loaded or unloaded, such as when the blade 38 is in an above-ground position. The above-described flow pattern reverses when the controller 14 commands movement of the spool of the directional control valve 96 beyond the neutral position in the opposing direction (corresponding to the arrow 110). Thus, by modulating the directional control valve 96 in this latter manner, the controller 14 can cause the motor output shaft 108 and the blade 38 to rotate in the opposing rotational direction when so commanded via blade rotation commands received via the operator input device 76.

When the controller 14 instead causes movement the spool of the mode selector valve 98 into the second stable position (FIG. 4), the power elements 102, 104 are placed in a parallel flow arrangement to shift the two speed hydraulic motor 100 into the HT/LS mode. Consider, again, an example scenario in which the spool of the directional control valve 96 resides in the positional extreme corresponding to arrow 112. In this case, hydraulic fluid flow received at an inlet port of the mode selector valve 98 is apportioned between the flowlines 90-3, 90-5 and is consequently directed through the power elements 102, 104 in parallel. After flowing through the power elements 102, 104, the hydraulic fluid is conducted to the inlet ports of the mode selector valve 98 via the flowlines 90-4, 90-6. The hydraulic fluid flow is then consolidated within the mode selector valve 98, discharged through an outlet of the valve 98, and returned to sump 92 through the flowline 90-8. This results rotation of the motor output shaft 108 and, therefore, motor grader blade 38 in the first rotational direction. Again, the above-described flow pattern reverses when the spool of the directional control valve 96 is instead moved past the neutral position in the direction indicated by arrow 110 to drive rotation of the motor output shaft 108 and the blade 38 in the second, opposing direction. The controller 14 may shift the two speed hydraulic motor 100 in the HT/LS mode of operation when the blade 38 resides in an in-ground position or is otherwise heavily loaded, as discussed below.

In embodiments, the controller 14 determines when to transition the two speed hydraulic motor 100 based, at least in part, on one or more sensor inputs indicative the load forces resisting blade rotation about the blade rotation axis 58 (herein, also referred to as the "anti-rotation load forces"). Such sensor input may directly measure blade load utilizing, for example, a force sensor included in the additional sensors 70-4 and mechanically coupled between the motor output shaft 108 and the motor grader blade 38. In such embodiments, the controller 14 may be configured to transition the two speed hydraulic motor 100 from the LT/HS mode to the HT/LS mode when the anti-rotation load forces exerted on the motor grader blade 38 surpass a predetermined threshold value and further return the hydraulic motor 100 to the LT/HS mode when the anti-rotation load forces exerted on the blade 38 again fall below the predetermined threshold. In other instances, the controller 14 may receive sensor input indirectly corresponding to the anti-rotation load forces encountered during rotation of the blade 38. For example, embodiments of the closed loop feedback circle drive system 12-1 may include at least one pressure sensor configured to monitor pressure in a flowline fluidly coupled between an outlet of the pump 94 and a port of the two speed hydraulic motor 100. In this latter instance, the controller 14 may monitor this hydraulic pressure utilizing the pressure sensor(s), such as pressure sensor 70-1 or 70-2 (discussed below) and then issue the appropriate commands to transition the two speed hydraulic motor 100 from the LT/HS mode to the HT/LS mode when the monitored pressure within a flowline surpasses a predetermined value.

In keeping with the foregoing discussion, the closed loop feedback circle drive system 12-1 is depicted as containing two pressure sensors 70-1, 70-2. The controller 14 may receive data indicative of the hydraulic pressure within the flowline 90-3 from the pressure sensor 70-1 and, therefore, upstream of the two speed hydraulic motor 100 when the fluid flow through the circuit occurs in a first direction (generally clockwise in the illustrated schematic). The controller 14 may then utilize this pressure data to determine when to switch the two speed hydraulic motor 100 between its operational modes or states. For example, when the pressure within the flowline 90-3 surpasses a predetermined threshold, the controller 14 may command the mode selector valve 98 to place the two speed hydraulic motor 100 in the HT/LS mode of operation (FIG. 4). When the pressure within the flowline 90-3 again falls below the threshold value, the controller 14 may then command the mode selector valve 98 to return the hydraulic motor to the LT/HS mode of operation (FIG. 3). Conversely, when the spool of the directional control valve 96 is moved such that hydraulic fluid flow occurs in the opposing direction (generally counterclockwise in the illustrated example), the controller 14 may utilize the pressure sensor 70-2 to monitor the hydraulic pressure within the flowline 90-4 upstream of the hydraulic motor 100. Again, the controller 14 may command mode selector valve 98 to place the two speed hydraulic motor 100 in the HT/LS mode (FIG. 4) when the pressure within the flowline 90-4 surpasses a predetermined threshold value, thus indicating a high torque demand placed on the blade 38.

In other embodiments, a different number of pressure sensors and/or a different control scheme may be utilized. For example, a single pressure sensor may be utilized to monitor the greater pressure in either flowlines 90-3, 90-4 by, of example, utilizing a shuttle valve (or similar device) to direct the higher pressure from either of the flowlines 90-3, 90-4 to the pressure sensor in a manner akin to that described below in connection with FIG. 5.

In addition to or in lieu of considering senor input indicative of the actual load resisting rotation of the motor grader blade 38, the controller 14 may also consider sensor inputs predictive of a current blade load or an anticipated blade load when determining when to place the two speed hydraulic motor 100 in a particular operational mode. For example, in one embodiment, the controller 14 may monitor whether the motor grade blade 38 currently resides in either of an above-ground or in-ground position; e.g., via a blade height or depth sensor included in one or more additional sensors 70-4 included in the circle drive system 12-1. The controller 14 may then modulate the operational state of the two speed hydraulic motor 100 accordingly. Specifically, in such embodiments, the controller 14 may command mode selector valve 98 to place the two speed hydraulic motor 100 in the LT/HS mode of operation (FIG. 3) when the determining that the blade 38 is in an above-ground position. Conversely, the controller 14 may command and further switch the hydraulic motor 100 into the HT/LS mode when the determining that the blade 38 is in an in-ground position. In other implementations, a similar approach may be employed utilizing a different predictive factor or event, such as a predetermined blade penetration depth; e.g., the controller 14 may place the two speed hydraulic motor 100 in the HT/LS mode of operation (FIG. 4) when the blade 38 penetrates into the ground (or other material) by a set depth. In still other embodiments, a more complex control scheme may be employed in which both blade penetration depth and blade load is considered.

In at least some implementations, the controller 14 of the closed loop feedback circle drive system 12-1 also beneficially adjusts a rotational speed of the motor output shaft 108 to minimize variances in the rotational speed of the motor grader blade 38 when shifting the two speed hydraulic motor 100 between the LT/HS mode and the HT/LS mode. To a certain extent, this may inherently occur due to the execution of a closed loop feedback control scheme by the controller 14, examples of which are set-forth below. Additionally or alternatively, the controller 14 may adjust the positioning of the spool of the directional control valve 96 by a predetermined amount or a set linear displacement when shifting the two speed hydraulic motor 100 between the HT/LS mode and the LT/HS mode. For example, in this case, the controller 14 may command the valve actuator 114 to move or "jump" the spool of the directional control valve 96 by a predetermined translational displacement, which represents a best guess movement of the spool to generally maintain the motor output speed through the transition in the operational modality of the hydraulic motor 100. Following this, the controller 14 may then adjust spool position within the directional control valve 96 in accordance with a closed loop control scheme, as described more fully below.

In addition to determining when to shift the two speed hydraulic motor 100 between modes of operation, the controller 14 further regulates the rate and direction of hydraulic fluid flow through the hydraulic motor 100 to generally maintain the rotational speed of the motor output shaft 134 at commanded levels despite variances in blade loading conditions. The controller 14 may execute various different closed loop feedback control scheme in accordance with computer-readable instructions or code stored in the memory 16 to carry-out this function. In one example approach, the controller 14 initially establishes a current rotational velocity of the motor grader blade 38 ($v_{blade_current}$). The controller 14 can establish the current blade rotational velocity ($v_{blade_current}$) utilizing various sensor inputs provided by the sensors 70 contained in the circle drive system 12-1. For example, the controller 14 may monitor the angular or rotational position of the motor grader blade 38 utilizing a circle rotate angle sensor included in the additional sensor 70-4. In other instances, the controller 14 may monitor the angular position of another component in the rotation transmission chain that co-rotates with the blade 38 in a fixed (1:1 or other proportional) relationship. The controller 14 may then convert changes in blade angle over time to a corresponding current blade rotational velocity ($v_{blade_current}$). In still other embodiments, the controller 14 may monitor the current blade rotational velocity ($v_{blade_current}$) in a more direct manner; e.g., utilizing a sensor configured to monitor the rotational speed of the motor output shaft 108 or another component that co-rotates therewith. For example, as indicated in FIG. 4, a sensor 70-3, such as a rotary differential transformer or a MEMS device (e.g., a MEMS accelerometer and/or gyroscope) may monitor the rotational speed of the motor output shaft 108 and provide this information to the controller 14.

After, before, or concurrently with establishing the current blade rotational velocity ($v_{blade_current}$), the controller 14 further determines a target rotational velocity of the motor grader blade 38 ($v_{blade_target}$). Generally, the controller 14 determines $v_{blade_target}$ as a function of operator command signals received via the operator input device 76. In embodiments, the target blade rotational velocity ($v_{blade_target}$) may be mapped to the displacement of the operator input device 76 in a substantially proportional relationship. In embodiments in which the operator input device 76 assumes the form of a joystick or lever, the controller 14 may determine the magnitude and direction of from a neutral or home position and then convert this value to a corresponding target blade rotational velocity ($v_{blade_target}$). For example, the controller 14 may determine that an operator has moved the joystick by a particular percentage (e.g., 25%) of the joystick's maximum range of motion (ROM) away from the neutral position in a first direction, and then convert this joystick displacement to a corresponding percentage (e.g., 25%) of the maximum rotational velocity of the blade 38 in a first rotational direction. Similarly, a 25% displacement of the joystick from the neutral joystick position (that is, 25% of the maximum range of motion of the joystick) in a second, opposing direction may be likewise converted to a value of 25% of a maximum rotational velocity of the blade 38 in a second, opposing rotational direction. In other embodiments, movements of the operator input device 76 may be mapped or converted to the target blade rotational velocity ($v_{blade_target}$) utilizing a different approach, such as a position-based approach in which movement of a joystick from a first position to a second position in a given time period is converted to a corresponding blade rotational velocity.

Next, the controller 14 calculates the difference or disparity (herein, "$v_{blade_\Delta}$") between the target blade rotational velocity ($v_{blade_target}$) and the current blade rotational velocity ($v_{blade_current}$). In certain instances, the disparity $v_{\Delta}$ between $v_{blade_target}$ and $v_{blade_current}$ may be zero, including in instances in which the motor grader blade is desirably stationary (in which case $v_{blade_target}$ and $v_{blade_current}$ will likewise have values of zero). In other instances, such as when an operator input via the operator input device 76 is received commanding blade rotation and the rotation of the motor grader blade is resisted by a load, a non-zero disparity may develop between $v_{blade_target}$ and $v_{blade_current}$. If the value of $v_{\Delta}$ exceeds a predetermined threshold, the controller 14 adjusts the rotational speed of the multi-speed hydraulic motor 100 in the above-described manner to reduce the discrepancy ($v_{blade_\Delta}$) between the current blade rotational velocity ($v_{blade_current}$) and the target blade rotational velocity ($v_{blade_target}$). The predetermined threshold can have a value of zero in embodiments, but will more commonly have a non-zero value to prevent repeated minor adjustments of the rotational velocity of the blade 38. The value of the predetermined threshold may be stored as a fixed parameter in the memory 16 or, instead, may be adjustable to operator or customer preference as a "sensitivity" setting of the circle drive system 12-1.

The controller 14 then repeats the above-described process steps on a relatively rapid (e.g., near real-time) iterative basis to provide closed loop feedback control governing the rotational speed of the motor grader blade 38. In this manner, the controller 14 effectively ensures the motor grader blade 38 will achieve a desired rotational velocity independent of the load resisting blade rotation. A more consistent relationship between control input (e.g., joystick) displacements and the rotational speed of the motor grader blade 38 across different iterations of motor grader operation can thus be maintained to improve operator satisfaction and productivity levels. Concurrently, the closed loop feedback circle drive system 12-1 retains the usage of a multi-speed hydraulic motor (i.e., two speed hydraulic motor 100) to allow a reduction in the size and hydraulic demands of the motor relative to fixed displacement motors, thereby preserving rapid execution of hydraulic-driven functions during motor grader turnaround.

EXAMPLE IMPLEMENTATION OF THE CLOSED LOOP FEEDBACK CIRCLE DRIVE SYSTEM INCLUDING A VARIABLE DISPLACEMENT HYDRAULIC MOTOR

Figure 5:
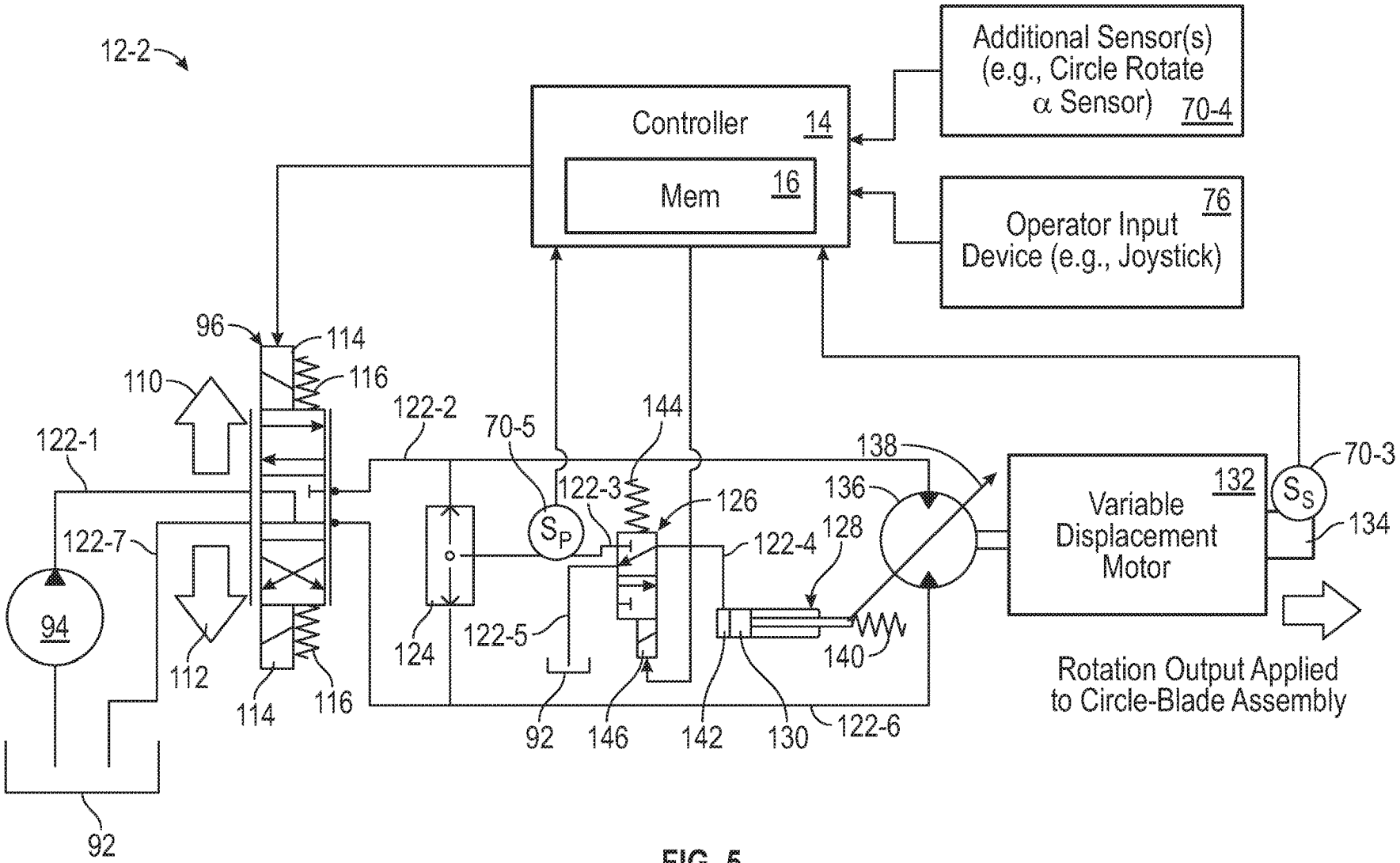
FIG. 5 is a schematic of a second example implementation of the closed loop feedback circle drive system, which is further suitable for usage as the circle drive system generically shown in FIG. 1 and which includes a variable displacement hydraulic motor.

Turning lastly to FIG. 5, there is shown a schematic of a second example implementation of the closed loop feedback circle drive system 12-2, which is further suitable for usage as the circle drive system 12 generically shown in FIG. 1. In many respects, the closed loop feedback circle drive 12-2 is similar to the closed loop feedback circle drive 12-1 described above in connection with FIGS. 3 and 4. For example, the closed loop feedback circle drive system 12-2 includes the above-described controller 14, the memory 16, the operator input device 76, the speed sensor 70-3, the additional sensors 70-4, the sump 92, and the pump 94. These components have been previously described and will not be described in detail here to avoid redundancy. Components from the foregoing list may be modified to a certain extent relative to the previous description, however, as appropriate to support the operation of the closed loop feedback circle drive 12-2; e.g., the computer-readable code residing in the memory 16 will differ to allow the controller 14 to perform a different control scheme suitable for controlling a variable displacement hydraulic motor (e.g., the variable displacement hydraulic motor 132) rather than a two speed hydraulic motor, as explained below.

The example closed loop feedback circle drive system 12-2 shown in FIG. 5 further includes a flow network 122, which includes flowlines 122-1 through 122-7. The flow network 122 fluidly interconnects a pressure-actuated shuttle valve 124, a solenoid-operated selector valve 126, and a hydraulic actuator 128 including a spring-biased piston 130. As was previously the case with the circle drive system 12-1, the closed loop feedback circle drive system 12-2 also contains a hydraulic motor 132, which has a motor output shaft 134 and which is suitable for usage as the hydraulic circle rotate motor 60 generically described above in connection with FIGS. 1 and 2. However, in contrast to the example of FIGS. 3 and 4, the hydraulic motor 132 assumes the form of a variable displacement hydraulic motor and is consequently referred to hereafter as the "variable displacement hydraulic motor 132." The variable displacement hydraulic motor 132 includes a power element 136 fluidly disposed in the flow network 122 and a displacement adjustment mechanism 138 mechanically coupled to the rod end of the spring-biased piston 130.

In addition to the spring-biased piston 130, the hydraulic actuator 128 further contains a (e.g., coil compression) spring 140 and a hydraulic control chamber 142. Pressurization of the control chamber 142 is regulated by the controller 14 utilizing the solenoid-operated selector valve 126, which includes a spring 144 and a solenoid 146 operably coupled to the controller 14. When energized by the controller 14, the solenoid 146 exerts a force on the spool of the selector valve 126 sufficient to overcome the spring bias force of the spring 144 and thereby move the spool of the into the position indicated in the lower half of the symbol representing the valve 126. This, in effect, fluidly couples the flowline 122-3 to the flowline 122-4, which directs pressurized hydraulic fluid flow into the control chamber 142 of the hydraulic actuator 128. When the cumulative force acting on the face of the piston 130 is sufficient to overcome the bias force of the spring 140, the piston 130 extends to adjust the displacement adjustment mechanism 138 as commanded. Conversely, when it is desired to retract the piston 130, the controller 14 commands the solenoid 146 to move spool of the selector valve 126 toward the opposing position (indicated by the upper half of the symbol of the valve 126); e.g., stated more precisely, the controller 14 may deenergized the solenoid to movement of the spool of the selector valve 126 as the spring 144 decompresses. This fluidly couples the flowline 122-4 to the flow-line 122-5, thereby allowing hydraulic fluid outflow from the control chamber 142, through the selector valve 126, and to the sump 92 as the piston 130 retracts to adjust the displacement adjustment mechanism 138 as desired. In further embodiments, the hydraulic actuator 128 may be replaced by a different type of actuator, such as an electric linear actuator, which is utilized by the controller 14 to vary the displacement setting of the variable displacement hydraulic motor 132 in a like manner.

During operation of the closed loop feedback circle drive system 12-2, the controller 14 may control the operation of the variable displacement hydraulic motor 132 utilizing a closed loop feedback control scheme similar, if not substantially identical to that previously described in connection with FIGS. 3 and 4. Accordingly, the controller 14 may initially establish a target rotational velocity ($v_{target}$) of the motor grader blade 38 as a function of operator command signals received via the operator input device 76, as previously described. Next, the controller 14 then determines a discrepancy ($v_{blade_\Delta}$) between the blade rotational velocity ($v_{blade_target}$) and a current blade rotational velocity ($v_{blade_current}$), as determined utilizing one or more sensor inputs received from the sensors 70 (again, as previously described). Also, during this step and as indicated in FIG. 5, a single pressure sensor 70-5 may be utilized to monitor the pressure within the flowline 122-3, which is fluidly connected to the pressure within the flowline 122-2 or the pressure within flowline 122-6 (whichever is greater) by action of the shuttle valve 124. The controller 14 may then adjust the displacement setting of the variable displacement hydraulic motor 132 as a function of the hydraulic pressure detected by the pressure sensor 70-5. Lastly, the controller 14 modifies a rotational speed of the motor output shaft 134 (and rotational direction, as needed) to reduce the discrepancy ($v_{blade_\Delta}$) between the blade rotational velocity ($v_{blade_target}$) and the current blade rotational velocity ($v_{blade_current}$) if the discrepancy ($v_{blade_\Delta}$) exceeds a predetermined threshold value stored in the memory 16. In other embodiments, a different control scheme may be employed by the controller 14 suitably for providing closed loop feedback control of blade rotation utilizing the variable displacement hydraulic motor 132. In so doing, the controller 14 commands the variable displacement hydraulic motor 132 in a manner better maintaining the rotational speed of the motor output shaft 134 at desired levels despite variances in blade loading conditions. The consistency in which operator command inputs result in an expected blade speed rotation output is thus improved, while the rapid execution of hydraulic-driven functions during motor grader turnaround is maintained.

ENUMERATED EXAMPLES OF THE CLOSED LOOP FEEDBACK CIRCLE DRIVE SYSTEM

The following examples of the closed loop feedback circle drive system are further provided and numbered for ease of reference.

1. In a first example embodiment, the closed loop feedback circle drive system includes an operator input device, a blade rotatable about a blade rotation axis, and a multi-speed hydraulic motor having a motor output shaft. The motor output shaft is mechanically linked to blade such that rotation of the motor output shaft drives rotation of the blade about the blade rotation axis. A controller is operably coupled to the operator input device and to the multi-speed hydraulic motor. The controller is configured to: (i) receive blade rotation commands via the operator input device to rotate the blade about the rotation axis in a commanded manner; and (ii) control the multi-speed hydraulic motor to implement the blade rotation commands, while repeatedly adjusting the rotational speed of the motor output shaft to reduce variations in a rotational velocity of the blade due to changes in blade loading conditions occurring during motor grader operation.

2. The closed loop feedback circle drive system of example 1, further including a first sensor configured to monitor a parameter indicative of the rotational velocity of the blade. The controller is operably coupled to the first sensor and is configured to monitor a current blade rotational velocity ($v_{blade_current}$) utilizing data provided by the first sensor.

3. The closed loop feedback circle drive system of example 2, wherein the controller is further configured to: (i) establish a target rotational velocity ($v_{target}$) of the blade as a function of operator command signals received via the operator input device; (ii) determine a discrepancy ($v_{blade_\Delta}$) between the blade rotational velocity ($v_{blade_target}$) and the current blade rotational velocity ($v_{blade_current}$); and (iii) if the discrepancy ($v_{blade_\Delta}$) exceeds a predetermined threshold value, adjust the rotational speed of the motor output shaft to reduce the discrepancy ($v_{blade_\Delta}$) between the blade rotational velocity ($v_{blade_target}$) and the current blade rotational velocity ($v_{blade_current}$).

4. The closed loop feedback circle drive system of example 3, wherein the controller is configured to: (i) determine a displacement direction and magnitude of the operator input device relative to a neutral position thereof; and (ii) convert the displacement direction and magnitude of the operator input device to the blade rotational velocity ($v_{blade_target}$).

5. The closed loop feedback circle drive system of example 2, wherein the first sensor assumes the form of a rotation angle sensor configured to monitor a rotational angle of the blade.

6. The closed loop feedback circle drive system of example 2, wherein the first sensor assumes the form of a speed sensor configured to monitor the rotational speed of the motor output shaft.

7. The closed loop feedback circle drive system of example 1, further including a pump and a directional control valve, which is fluidly coupled between the pump and the multi-speed hydraulic motor. The controller is configured to adjust the rotational speed of the motor output shaft, at least in part, by controlling the directional control valve to vary a rate of hydraulic fluid flow through the multi-speed hydraulic motor.

8. The closed loop feedback circle drive system of example 1, wherein the multi-speed hydraulic motor includes a variable displacement hydraulic motor including a displacement adjustment mechanism. The controller is configured to adjust the rotational speed of the motor output shaft, at least in part, by adjusting a displacement setting of the variable displacement hydraulic motor utilizing the displacement adjustment mechanism.

9. The closed loop feedback circle drive system of example 1, wherein the multi-speed hydraulic motor includes a two speed hydraulic motor having first and second power elements. The closed loop feedback circle drive system further includes a selector valve fluidly coupled to the first and second power elements.

10. The closed loop feedback circle drive system of example 9, wherein the controller is operably coupled to the selector valve and is configured to adjust the rotational speed of the motor output shaft, at least in part, by selectively transitioning the selector valve between: (i) a first position in which the first and second power elements are fluidly coupled in series; and (ii) a second position in which the first and second power elements are fluidly coupled in parallel.

11. The closed loop feedback circle drive system of example 1, wherein the multi-speed hydraulic motor includes a two speed hydraulic motor operable in a low torque, high speed (LT/HS) mode and a high torque, low speed (HT/LS) mode. The controller is further configured to: (i) selectively shift the two speed hydraulic motor between the LT/HS range mode and the HT/LS mode during operation of the motor grader; and (ii) further control the two speed hydraulic motor to minimize variances in the rotational speed of the blade when shifting the two speed hydraulic motor between the LT/HS mode and the HT/LS mode.

12. The closed loop feedback circle drive system of example 11, further including a sensor configured to monitor a parameter indicative of blade loading conditions. The controller is operably coupled to the second sensor and further configured to determine when to shift the two speed hydraulic motor between the LT/HS mode and the HT/LS mode based, at least in part, on data received via the sensor.

13. The closed loop feedback circle drive system of example 12, further including a flowline and a directional control valve, which is fluidly coupled to the multi-speed hydraulic motor through the flowline. The sensor assumes the form of a pressure sensor configured to monitor a hydraulic pressure within the flowline. The controller is configured to determine when to shift the two speed hydraulic motor from the LT/HS mode to the HT/LS mode based, at least in part, on whether the hydraulic pressure exceeds a predetermined threshold value.

14. The closed loop feedback circle drive system of example 11, wherein the controller is configured to determine when to shift the two speed hydraulic motor from the LT/HS mode to the HT/LS mode based, at least in part, on whether the blade currently resides in an above-ground position or in an in-ground position.

15. In further embodiments, the closed loop feedback circle drive system includes an operator input device, a blade rotatable about a rotation axis, a multi-speed hydraulic motor having a motor output shaft mechanically linked to the blade, and a first sensor configured to monitor a parameter indicative of a rotational velocity of the blade. A controller is operably coupled to the operator input device, to the multi-speed hydraulic motor, and to the first sensor. The controller is configured to: (i) establish a blade rotational velocity ($v_{blade_target}$) as a function of operator command signals received via the operator input device; (ii) determine a discrepancy ($v_{blade_\Delta}$) between the blade rotational velocity ($v_{blade_target}$) and a current blade rotational velocity ($v_{blade_current}$); and (iii) modify a rotational speed of the motor output shaft to reduce the discrepancy ($v_{blade_\Delta}$) between the blade rotational velocity ($v_{blade_target}$) and the current blade rotational velocity ($v_{blade_current}$) if the discrepancy ($v_{blade_\Delta}$) exceeds a predetermined threshold value.

CONCLUSION

There has thus been provided embodiments of a closed loop feedback circle drive system for controlling a multi-speed circle rotate motor (e.g., a variable displacement or two speed hydraulic motor) utilized to adjust the rotational position of a motor grader blade. The above-described closed loop feedback circle drive systems increase the consistency in which operator command inputs result in an expected blade speed rotation output by reducing or eliminating variances in blade rotation speed with changing loading conditions. Concurrently, the circle drive systems utilize a multi-speed hydraulic motor to drive blade rotation, which enables rapid execution of hydraulic-driven functions to be better preserved during motor grader turnaround. Further, in embodiments in which the circle drive system contains a two speed hydraulic motor, the controller may selectively shift the two speed hydraulic motor between different a first (e.g., low torque, high speed) mode of operation and a second (e.g., high torque, low speed) mode of operation, while controlling the two speed hydraulic motor to minimize variations in motor speed when shifting between the operation modes. In the above-described manner, the manner in which operator control commands are translated to blade speed adjustments can be rendered more uniform and predictable across motor grader usage to improve operator experience and efficiency.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A closed loop feedback circle drive system utilized onboard a motor grader, the closed loop feedback circle drive system comprising:

an operator input device;

a blade rotatable about a blade rotation axis;

a multi-speed hydraulic motor having a motor output shaft mechanically linked to blade, rotation of the motor output shaft causing rotation of the blade about the blade rotation axis; and a controller operably coupled to the operator input device and to the multi-speed hydraulic motor, the controller configured to:

establish a target blade rotational velocity ($v_{blade_target}$) as a function of blade rotation commands received via the operator input device; and control the multi-speed hydraulic motor to implement the blade rotation commands, while modifying a rotational speed of the motor output shaft to reduce discrepancies between the target blade rotational velocity ($v_{blade_target}$) and a current blade rotational velocity ($v_{blade_current}$) due to variations in load forces resisting blade rotation during operation of the motor grader.

2. The closed loop feedback circle drive system of claim 1, further comprising a first sensor configured to monitor a parameter indicative of blade rotational velocity;

wherein the controller is operably coupled to the first sensor and is configured to monitor the current blade rotational velocity ($v_{blade_current}$) utilizing data provided by the first sensor.

3. The closed loop feedback circle drive system of claim 2, wherein the controller is further configured to:

determine a discrepancy ($v_{blade_\Delta}$) between the target blade rotational velocity ($v_{blade_target}$) and the current blade rotational velocity ($v_{blade_current}$); and modify the rotational speed of the motor output shaft to reduce the discrepancy ($v_{blade_\Delta}$) if exceeding a predetermined threshold value.

4. The closed loop feedback circle drive system of claim 2, wherein the first sensor comprises a rotation angle sensor configured to monitor a rotational angle of the blade.

5. The closed loop feedback circle drive system of claim 2, wherein the first sensor comprises a speed sensor configured to monitor the rotational speed of the motor output shaft.

6. The closed loop feedback circle drive system of claim 1, wherein the controller is configured to:

determine a displacement direction and magnitude of the operator input device relative to a neutral position thereof; and convert the displacement direction and magnitude of the operator input device to target blade rotational velocity ($v_{blade_target}$).

7. The closed loop feedback circle drive system of claim 1, further comprising:

a pump; and a directional control valve fluidly coupled between the pump and the multi-speed hydraulic motor;

wherein the controller is configured to adjust the rotational speed of the motor output shaft, at least in part, by controlling the directional control valve to vary a rate of hydraulic fluid flow through the multi-speed hydraulic motor.

8. The closed loop feedback circle drive system of claim 1, wherein the multi-speed hydraulic motor comprises a variable displacement hydraulic motor including a displacement adjustment mechanism; and wherein the controller is configured to adjust the rotational speed of the motor output shaft, at least in part, by adjusting a displacement setting of the variable displacement hydraulic motor utilizing the displacement adjustment mechanism.

9. The closed loop feedback circle drive system of claim 1, wherein the multi-speed hydraulic motor comprises a two speed hydraulic motor having first and second power elements; and wherein the closed loop feedback circle drive system further comprises a selector valve fluidly coupled to the first and second power elements.

10. The closed loop feedback circle drive system of claim 9, wherein the controller is operably coupled to the selector valve and is configured to adjust the rotational speed of the motor output shaft, at least in part, by selectively transitioning the selector valve between:

a first position in which the first and second power elements are fluidly coupled in series; and a second position in which the first and second power elements are fluidly coupled in parallel.

11. The closed loop feedback circle drive system of claim 1, wherein the multi-speed hydraulic motor comprises a two speed hydraulic motor operable in a low torque, high speed (LT/HS) mode and a high torque, low speed (HT/LS) mode; and wherein the controller is further configured to:

selectively shift the two speed hydraulic motor between the LT/HS range mode and the HT/LS mode during operation of the motor grader; and further control the two speed hydraulic motor to minimize variances in the rotational speed of the blade when shifting the two speed hydraulic motor between the LT/HS mode and the HT/LS mode.

12. The closed loop feedback circle drive system of claim 11, further comprising a sensor configured to monitor a parameter indicative of blade loading conditions;

wherein the controller is operably coupled to the sensor and further configured to determine when to shift the two speed hydraulic motor between the LT/HS mode and the HT/LS mode based, at least in part, on data received via the sensor.

13. The closed loop feedback circle drive system of claim 12, further comprising:

a flowline; and a directional control valve fluidly coupled to the multi-speed hydraulic motor through the flowline;

wherein the sensor comprises a pressure sensor configured to monitor a hydraulic pressure within the flowline; and wherein the controller is configured to determine when to shift the two speed hydraulic motor from the LT/HS mode to the HT/LS mode based, at least in part, on whether the hydraulic pressure exceeds a predetermined threshold value.

14. The closed loop feedback circle drive system of claim 11, wherein the controller is configured to determine when to shift the two speed hydraulic motor from the LT/HS mode to the HT/LS mode based, at least in part, on whether the blade currently resides in an above-ground position or in an in-ground position.

15. A closed loop feedback circle drive system utilized onboard a motor grader, the closed loop feedback circle drive system comprising:

an operator input device;

a blade rotatable about a blade rotation axis;

a multi-speed hydraulic motor having a motor output shaft mechanically linked to the blade;

a first sensor configured to monitor a parameter indicative of a rotational velocity of the blade; and a controller operably coupled to the operator input device, to the multi-speed hydraulic motor, and to the first sensor, the controller configured to:

establish a target blade rotational velocity ($v_{blade_target}$) as a function of operator command signals received via the operator input device;

determine a discrepancy ($v_{blade_\Delta}$) between the target blade rotational velocity ($v_{blade_target}$) and a current rotational velocity of the blade ($v_{current}$); and modify a rotational speed of the motor output shaft to reduce the discrepancy ($v_{blade_\Delta}$) between the target blade rotational velocity ($v_{blade_target}$) and the current rotational velocity ($v_{current}$) of the blade if the discrepancy ($v_{blade_\Delta}$) exceeds a predetermined threshold value.

16. The closed loop feedback circle drive system of claim 15, further comprising:

a pump; and a directional control valve fluidly coupled between the pump and the multi-speed hydraulic motor;

wherein the controller is configured to modify the rotational speed of the motor output shaft by varying hydraulic fluid flow through the multi-speed hydraulic motor utilizing the directional control valve.

17. The closed loop feedback circle drive system of claim 16, wherein the multi-speed hydraulic motor comprises one or more of a variable displacement hydraulic motor or a two speed hydraulic motor.

18. A closed loop feedback circle drive system utilized onboard a motor grader, the closed loop feedback circle drive system comprising:

a two speed hydraulic motor having a motor output shaft, the two speed hydraulic motor operable in a low torque, high speed (LT/HS) mode and a high torque, low speed (HT/LS) mode;

a blade mechanically linked to the two speed hydraulic motor and selectively rotated thereby about a blade rotation axis;

a controller operably coupled to the two speed hydraulic motor, the controller configured to:

selectively shift the two speed hydraulic motor between the LT/HS mode and the HT/LS mode during operation of the closed loop feedback circle drive system; and further control a rotational speed of the motor output shaft to minimize variances in a rotational speed of the blade when shifting the two speed hydraulic motor between the LT/HS mode and the HT/LS mode.

19. The closed loop feedback circle drive system of claim 18, further comprising:

a pump; and a directional control valve fluidly coupled between the pump and the two speed hydraulic motor;

wherein the controller is further operably coupled to the directional control valve and is configured to control an output speed of the two speed hydraulic motor by selectively shifting the two speed hydraulic motor between the LT/HS mode and the HT/LS mode, while modulating the directional control valve to regulate a rate and direction of hydraulic fluid flow through the two speed hydraulic motor.

20. The closed loop feedback circle drive system of claim 18, further comprising:

an operator input device; and a sensor configured to monitor a parameter of the closed loop feedback circle drive system indicative of a rotational velocity of the blade;

wherein the controller is operably coupled to the operator input device and to the sensor, the controller further configured to:

determine a target blade rotational velocity ($v_{blade_target}$) as a function of operator command signals received via the operator input device;

estimate a difference ($v_{\Delta}$) between the target blade rotational velocity ($v_{blade_target}$) and a current rotational velocity of the blade ($v_{current}$); and if $v_{\Delta}$ exceeds a threshold value, adjust an output speed of the variable speed motor to reduce $v_{\Delta}$.

* * * * *